US007129434B2

(12) United States Patent
Wakatsuki et al.

(10) Patent No.: US 7,129,434 B2
(45) Date of Patent: Oct. 31, 2006

(54) ELECTRIC CONTACT DEVICE

(75) Inventors: Noboru Wakatsuki, Ishinomaki (JP); Yu Yonezawa, Miyagi (JP); Yoshio Satoh, Kawasaki (JP); Tadashi Nakatani, Kawasaki (JP); Tsutomu Miyashita, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/281,949

(22) Filed: Nov. 18, 2005

(65) Prior Publication Data

US 2006/0128177 A1 Jun. 15, 2006

Related U.S. Application Data

(63) Continuation of application No. PCT/JP03/06300, filed on May 20, 2003.

(51) Int. Cl.
*H01H 1/10* (2006.01)

(52) U.S. Cl. ..... 200/512; 200/520; 200/5 A

(58) Field of Classification Search ..... 200/511–512, 200/520, 5 A, 5 R, 341, 1 R
See application file for complete search history.

(56) References Cited

U.S. PATENT DOCUMENTS

| | | | | |
|---|---|---|---|---|
| 4,079,651 | A * | 3/1978 | Matsui | 84/690 |
| 4,121,204 | A * | 10/1978 | Welch et al. | 345/174 |
| 4,459,321 | A | 7/1984 | Kim | |
| 5,660,269 | A * | 8/1997 | Fujiwara | 200/275 |
| 6,114,645 | A * | 9/2000 | Burgess | 200/512 |
| 6,469,267 | B1 * | 10/2002 | Welsh et al. | 200/512 |
| 6,504,492 | B1 * | 1/2003 | Muurinen | 341/22 |
| 2002/0140533 | A1 | 10/2002 | Miyazaki et al. | |
| 2003/0042561 | A1 | 3/2003 | Funaki | |

FOREIGN PATENT DOCUMENTS

| | | |
|---|---|---|
| JP | 56-156621 | 12/1981 |
| JP | 59-127323 | 7/1984 |
| JP | 61-232523 | 10/1986 |
| JP | 61-296612 | 12/1986 |
| JP | 62-123614 | 6/1987 |
| JP | 62-147611 | 7/1987 |
| JP | 2001-76605 | 3/2001 |
| JP | 2002-367325 | 12/2002 |
| JP | 2003-71798 | 3/2003 |

* cited by examiner

*Primary Examiner*—K. Lee
(74) *Attorney, Agent, or Firm*—Staas & Halsey LLP

(57) ABSTRACT

An electrical contact device (X1) includes a first contactor with contact portions (C1, C2) and a second contactor with contact portions (C3, C4). The device (X1) also includes an electrical circuit having a branch path (YA) provided by the contact portions (C1, C3) and a branch path (YB) provided by the contact portions (C2, C4). When closed, the branch path (YA) has a smaller resistance, and the branch path (YB) a greater resistance. In a closing operation, the first and second contactors approach each other. Then the contact portion (C1) and the contact portion (C3) contact with each other after the contact portion (C2) and the contact portion (C4) contact with each other. In an opening operation, the first and second contactors separate from each other. Then the contact portion (C1) and the contact portion (C3) separate after the contact portion (C2) and the contact portion (C4) separate.

17 Claims, 13 Drawing Sheets

ELECTRIC CONTACT DEVICE

This application is a continuing application, filed under 35 U.S.C. § 111(a), of International Application PCT/JP2003/006300, filed May 20, 2003.

TECHNICAL FIELD

The present invention relates to electrical contact devices which have an electrical contact that opens and closes mechanically and are applicable to switches, relays and so on.

BACKGROUND ART

An electrical contact is an element for electric circuitry for mechanically closing and opening an electric path by mechanical open/close operation of a pair of contact points. The electrical contact is utilized in switches, relays and so on. Switches and relays which make use of the electrical contact have an advantage that it can provide an excellent open state having a very large electric resistance since the two electrical contact points are mechanically spaced from each other under the open state. For this reason, such mechanical switches and relays are widely used in all fields including information equipment, industrial machinery, automobiles and home electric appliances, as switching means for opening and closing electric circuits composed of power sources, actuators, sensors, and so on.

FIG. 12 and FIG. 13 show a conventional, mechanically opened/closed electrical contact device X3. The electrical contact device X3 includes a mover 71 and a stator 72.

The mover 71 includes a conductor strip 73, a contact 74 provided at an end of the conductor strip 73 and a socket 75 attached to the conductor strip 73. A single conductor strip 73 is provided with a single contact 74. The contact 74 is made of a conductor. The socket 75 is made of resin. The conductor strip 73 has another end to which a lead 76 made of braided copper wire for example is attached mechanically and electrically. The lead 76 is electrically connected with an unillustrated circuit. A pin 77 is inserted through the socket 75, and the mover 71 can swing around the pin 77. The pin 77 is fixed to a predetermined case (not illustrated) which encloses the electrical contact device X3. Pivotal movement of the mover 71 is achieved by a predetermined drive mechanism (not illustrated) which includes an exciting coil for example.

The stator 72 includes the conductor strip 78 and a contact 79 which is made of a conductor. The conductor strip 78 is electrically connected with an unillustrated circuit. The contact 79 is placed on a pivotal path of the contact 73 in the pivotal movement of the mover 71.

In the electrical contact device X3 constructed as the above, assume that a predetermined voltage is applied between the contact 74 and the contact 79. When the mover 71 pivots toward the stator 72 as shown in FIG. 13, bringing the contact 74 into contact with the contact 79, the electric current flows, for example, from the conductor strip 78 through the contact 79, the contact 74, and the conductor strip 73, to the lead 76. Thereafter, when the mover 71 pivots away from the stator 72 as shown in FIG. 12, moving the contact 74 away from the contact 79, the current flow stops. In this way, the electrical contact device X3 connects and disconnects the electric path.

In the field of electrical contact technology, it is known that arcing occurs between a pair of contacts if the contacts are operated into an open state while an electric current is flowing through the closed contacts at a rate exceeding a threshold value (minimum discharge current), or while an electric potential difference is present between the contacts at a rate exceeding a threshold value (minimum discharge voltage). Assume for example, that a closed pair of contacts is to be opened while an electric current which exceeds the threshold value is flowing. As the contacts are being opened, the touching area of the contacts decreases gradually, causing the current to pass through the contacts in an increasingly concentrated manner. As the concentration of the current increases, the temperature of the contacts increases, and surfaces of the contacts melt. Because of this, even after the contacts have been opened, the molten contact material keeps the contacts connected with each other for a period of time while the distance between the two contacts are not large enough. In other words, a bridge is formed between the contacts. From the bridge comes out vapor of the metal, which serves as a medium for arc discharge. The arc discharge develops into a phase where arcing is transmitted by ambient gas, and eventually ceases when the contacts have been spaced from each other by a sufficient distance. This is how arc discharge develops when contacts are opened. A similar mechanism may cause arc discharge when electrical contacts are being closed, because the electrical contacts repeat an intermittent open/close action (bounce) as they are being closed.

FIG. 14 is a graph as an example, which shows dependency of arc discharge probability on electric current between contacts. The graph plots arc discharge probability values when a pair of gold contacts were contacted with each other under a predetermined pressure (10 mN, 100 mN, or 200 mN) and the contacts were opened while a 36 volts was applied between the two. The electrical contacts were connected with a 36-volt constant-voltage power source, with a resistor placed in series. By varying the resistance of the resistor, the electric current flowing through the contacts was varied. The substantial area of contact between the two contacts was believed to be not greater than a few tens of square micrometers. The graph's horizontal axis represents the current which flew through the contacts whereas the vertical axis represents arc discharge probability. Under any closing pressure, arc discharge probability shows about 100% once the applied current reaches or exceeds 0.6 A. On the other hand, when the applied current is 0.1 A or less, arc discharge probability is generally 0%. More details about this graph can be obtained from Yu. Yonezawa, et al. (Japanese Journal of Applied Physics, Japanese Society of Applied Physics, July 2002, Vol. 41, Part 1, No. 7A, pp4760–4765).

From the graph in FIG. 14, it is understood that a minimum discharge current (minimum arc current) Imin which triggers arc discharge is somewhere between 0.1 A and 0.6 A. The minimum discharge current Imin is known to be dependent upon the material species. Likewise, there is a minimum voltage (minimum arc voltage) Vmin necessary for causing arc discharge, which is also known to be dependent upon the material species. For gold contacts, it is reported that the minimum discharge current Imin is 0.38 A, and the minimum discharge voltage Vmin is 15V. It must be understood however, that Imin and Vmin values obtained from actual measurements are not always the same due to influences from the state of electric charge in the space, conditions of the contact surfaces and so on.

When the electrical contact device X3 is closed, all of the electric current needed by the load circuit (an unillustrated circuit which draws the current) flows through the contact 74 and the contact 79. Therefore, if the current drawn by the load circuit exceeds the minimum discharge current, arc discharge is inevitable between the contact 74 and the contact 79 when the contacts are opened. It is not uncommon that the current drawn by the load circuit exceeds the minimum discharge current of the electrical contact device X3.

Every cycle of arc discharge causes melting, evaporation and re-solidification of the material which constitutes the contacts 74, 79, resulting in erosion and transfer of the contact material as well as alteration of contact resistance between the contact 74 and the contact 79. For this reason, reliability and lifetime of the electrical contact device X3 tends to decrease with the number of arc discharges occurring between the contact 74 and contact 79. Reduction in reliability and shortening of lifetime are significant when a large current has to be handled by the electrical contact device X3.

In a conventional electrical contact device X3, it is common that in order to achieve sufficiently small contact resistance in the closed state, the contacts 74, 79 are made of low-resistance metals. Typically, a copper base-material is coated with a low-resistance, corrosion-resistant metal (e.g. Au, Ag, Pd and Pt). However, these low-resistance metals have a relatively low melting point, which means that they easily become molten in the heat generated by arc discharge, and erode or transfer. Metals which are not easily melted in the heat generated by arc discharge have a relatively large electric resistance. In the conventional electrical contact device X3 in which lowering the contact resistance is an important goal, it is practically difficult to use metals which have a high melting point.

DISCLOSURE OF THE INVENTION

The present invention was made under the circumstances described above, and it is therefore an object of the present invention to provide an electrical contact device which is capable of appropriately reducing arc discharge that occurs between the contacts.

A first aspect of the present invention provides an electrical contact device. The electrical contact device includes a first contactor which has a first contact portion and a second contact portion, and a second contactor which has a third contact portion facing the first contact portion and a fourth contact portion facing the second contact portion. The electrical contact device further includes an electrical circuit which has a first branch path and a second branch path disposed in parallel to each other. The first branch path has a first electrical contact provided by the first contact portion and the third contact portion. The second branch path has a second electrical contact provided by the second contact portion and the fourth contact portion. The first branch path has a smaller resistance in a closed state of the first electrical contact, whereas the second branch path has a greater resistance in a closed state of the second electrical contact. In this device, the first contact portion and the third contact portion make contact with each other after the second contact portion and the fourth contact portion make contact with each other in a closing operation in which the first contactor and the second contactor come closer to each other. On the other hand, the second contact portion and the fourth contact portion come apart from each other after the first contact portion and the third contact portion come apart from each other in an opening operation in which the first contactor and the second contactor move away from each other.

FIG. 1 shows a circuit Y1 in the electrical contact device according to the first aspect of the present invention. The circuit Y1 includes a first branch path YA and a second branch path YB connected in parallel to each other.

The first branch path YA includes a first electrical contact SA which is composed of a first contact portion C1 and a third contact portion C3, and a resistor Ra which is connected in series therewith. The resistor Ra includes a resistor whose resistance is virtually 0 ohm. In a state where the first contact portion C1 and the third contact portion C3 are closed, i.e. when the first electrical contact SA is closed, the first electrical contact SA has a contact resistance Ra'. Therefore, the first branch path YA has a total resistance RA (=Ra+Ra') when the first electrical contact SA is closed.

The second branch path YB includes a second electrical contact SB which is composed of a second contact portion C2 and a fourth contact portion C4, and a resistor Rb which is connected in series therewith. The resistor Rb includes a resistor whose resistance is virtually 0 ohm. In a state where the second contact portion C2 and the fourth contact portion C4 are closed, i.e. when the second electrical contact SB is closed, the second electrical contact SB has a contact resistance Rb'. Therefore, the second branch path YB has a total resistance RA (=Rb+Rb') when the second electrical contact SB is closed. The total resistance RB of the second branch path YB is greater than the total resistance RA of the first branch path YA.

FIG. 2A through FIG. 2C show changes in the circuit Y1 in an open/close operation of the electrical contact device according to the first aspect of the present invention. During the operation, a predetermined voltage Vin (DC or AC) is applied between terminals E1, E2 by a power source. Also, during the operation, an input impedance or an output impedance $R_1$ or $R_2$ is placed in series with the electrical contact device. The impedances $R_1$ and $R_2$ represent impedances of a load circuit to which the power is supplied. The impedances can vary widely depending on the configuration of the load circuit, but in general have a value (e.g. 10 ohms or greater) which is sufficiently larger than the total resistance of the electrical contact device.

FIG. 2A shows an open state of the electrical contact device. In the open state, both of the electrical contacts SA, SB are open. FIG. 2B shows a transition state of the electrical contact device. In the transition state, the first electrical contact SA is open and the second electrical contact SB is closed. FIG. 2C shows a closed state of the electrical contact device. In the closed state, both of the electrical contacts SA, SB are closed.

In the open state (FIG. 2A), if the voltage Vin is applied between the terminals E1, E2, the first branch path YA and the second branch path YB which are parallel to each other are under the same voltage.

With the voltage Vin being applied between the terminals E1, E2, a closing operation is now to be made, in which the first contactor which has the contact portions C1, C3 is brought closer to the second contactor which has contact portions C2, C4. First, as shown in FIG. 2B, the second electrical contact SB comes to a closed state. As a result, the second branch path YB is passed by a current determined by the total resistance RB (=Rb+Rb'). The larger the RB is, the smaller is the current. Therefore, by making RB sufficiently large, the current which passes the second electrical contact SB of the second branch path YB is made smaller than a minimum discharge current of the electrical contact SB. This enables to appropriately reduce occurrence of arc discharge even if the second contact portion C2 bounces off the third contact portion C4 in a moment when the second electrical contact SB closes, as shown in FIG. 2B.

In the transition state, when the closing operation is continued to bring the first contactor closer to the second contactor, the first electrical contact SA comes to a closed state as shown in FIG. 2C. As a result, the first branch path YA is passed by a current determined by the total resistance RA (=Ra+Ra'). The total resistance RA of the first branch path YA is smaller than the total resistance RB of the second branch path YB. Therefore, when the first electrical contact SA is closed, the first branch path YA is passed by a current which is greater than in the second branch path YB. However, the voltage applied between the contact portions of the first electrical contact SA in the transition state (FIG. 2B) is smaller than in the open state (FIG. 2 A), so at the moment when the first electrical contact SA is closed, occurrence of arc discharge is reduced. The electrical contact device is adjusted so that the voltage between two contact portions in the first electrical contact SA is sufficiently small in the transition state. Such an adjustment can be made by e.g. adjusting the total resistance RB in the second branch path YB.

When both of the electrical contacts SA, SB are closed, a predetermined amount of current determined by the resistances RA, RB passes through the electrical contact device.

Now, with the electrical contact device being in the closed state, an opening operation is made, in which the first contactor and the second contactor move away from each other. First, as shown in FIG. 2B, the first electrical contact SA comes to an open state. At the moment when the first electrical contact SA is opened, the second electrical contact SB is still closed, so voltage surge between the contact portions in the first electrical contact SA is reduced. As a result, occurrence of arc discharge at the moment when the first electrical contact SA is opened is reduced.

In the transition state, as the opening operation is continued so that the first contactor and the second contactor continue to move away from each other, the second electrical contact SB also comes to an open state as shown in FIG. 2A, following the first electrical contact SA. During this, occurrence of arc discharge is reduced for the same reason why occurrence of arc discharge is reduced at the moment when the second electrical contact SB is closed.

As has been described, according to the electrical contact device offered by the first aspect of the present invention, it is possible to reduce occurrence of arc discharge in the entire closing operation of the device, by closing the second electrical contact SB in the high-resistance second branch path YB before the closure of the first electrical contact SA in the first branch path YA which is the low-resistance path for a predetermined large current to pass. Also, according to the electrical contact device offered by the first aspect of the present invention, it is possible to reduce occurrence of arc discharge in the entire opening operation of the device, by opening the second electrical contact SB in the high-resistance second branch path YB after opening the first electrical contact SA in the first branch path YA which is the low-resistance path for a predetermined large current to pass. In addition, according to the electrical contact device offered by the first aspect of the present invention, the operation as described above for suppressing arc discharge is achieved by a close-in movement and a break-away movement between the first contactor and the second contactor.

In the first aspect of the present invention, preferably, the first contact portion is spaced from the third contact portion by a distance greater than a distance between the second contact portion and the fourth contact portion, in an open state where the first electrical contact assumes an open state and the second electrical contact assumes an open state. An arrangement such as this is suitable for opening and closing the first electrical contact and the second electrical contact appropriately at different timings.

Preferably, the second branch path includes a resistor which has a greater resistance than a contact resistance of the second electrical contact and is placed in series with the second electrical contact. This arrangement means that the resistor Rb has a significant resistance value in the above-described circuit Y1.

Preferably, the second electrical contact has a contact resistance which is greater than that of the first electrical contact.

Preferably, the second contact portion and/or the fourth contact portion is made of a metal, an oxide or a nitride including a metal element selected from a group consisting of Ta, W, C and Mo. Metals, oxides or nitrides including a metal element selected from a group consisting of Ta, W, C and Mo tend to have a high melting point and a high boiling point which are suitable for the electrical contacts. Further preferably, the second contact portion and/or the fourth contact portion is made of material which has a boiling point not lower than 3000° C.

In the field of electrical contact technology, lowering the contact resistance of the electrical contact has been believed to be essential. For this reason, the contacts have been made of a highly conductive metal such as Cu, Au, Ag, Pd and Pt and an alloy thereof. However, in the arrangement according to the present invention, a certain level of resistance is required for each second branch path, and so the contacts can be made from those metal materials which have a high resistance and therefore have not been practical for the contacts. Thus, in the present invention, materials which have a high resistance and a high melting or boiling point can be utilized as the material for the contact. If the contacts are formed of a material which has a high melting or boiling point, erosion and transfer of the contact material due to melting or evaporation is reduced. This enables to appropriately prevent deterioration of the contacts.

Preferably, the third contact portion and the fourth contact portion are included in one flat-surface electrode.

A second aspect of the present invention provides another electrical contact device. The electrical contact device includes: a first contactor which has a plurality of first contact portions and a plurality of second contact portions, and a second contactor which has a plurality of third contact portions each facing one of the first contact portions and a plurality of fourth contact portions each facing one of the second contact portions. The electrical device further includes an electrical circuit which has a plurality of first branch paths and a plurality of second branch paths disposed in parallel to each other. Each first branch path has a first electrical contact provided by the first contact portion and the third contact portion. Each second branch path has a second electrical contact provided by the second contact portion and the fourth contact portion. Each first branch path has a smaller resistance in a closed state of the first electrical contact, whereas each second branch path has a greater resistance in a closed state of the second electrical contact. In the device, the first contact portions and the third contact portions of all the first electrical contacts make contact with each other after the second contact portions and the fourth contact portions of all the second electrical contacts make contact with each other in a closing operation in which the first contactor and the second contactor come closer to each other. On the other hand, the second contact portions and the fourth contact portions of all the second electrical contacts come apart from each other after the first contact portions and the third contact portions of all the first electrical contacts come apart from each other in an opening operation in which the first contactor and the second contactor move away from each other.

FIG. 3 shows a circuit Y2 in the electrical contact device according to the second aspect of the present invention. The circuit Y2 includes a plurality of first branch paths YAi (i=1, 2, 3 . . . , m) and a plurality of second branch paths YBi (i=1, 2, 3 . . . , n). These branch paths YAi and YBi are connected in parallel to each other.

The first branch path YAi includes a first electrical contact SAi which is composed of a first contact C1*i* and a third contact C3*i*, and a resistor Rai which is connected in series therewith. The resistor Rai includes a resistor whose resistance is virtually 0 ohm. In a state where the first contact C1*i* and the third contact C3*i* are closed, i.e. when the first electrical contact SAi is closed, the first electrical contacts SAi has a contact resistance Ra'i. Therefore, the first branch paths YAi have a total resistance RAi (=Rai+Ra'i) when the first electrical contact SAi is closed.

The second branch path YBi includes a second electrical contact SBi which is composed of a second contact portion C2*i* and a fourth contact portion C4*i*, and a resistor Rbi which is connected in series therewith. The resistor Rbi includes a resistor whose resistance is virtually 0 ohm. In a state where the second contact portion C2*i* and the fourth contact portion C4*i* are closed, i.e. when the second electrical contact SBi is closed, the second electrical contact SBi has a contact resistance Rb'i. Therefore, the second branch paths YBi have a total resistance RBi (=Rbi+Rb'i) when the second electrical contacts SBi are closed. The total resistance RBi of the second branch path YBi is greater than the total resistance RAi of the first branch path YAi. The circuit Y2 can also be represented by an equivalent circuit Y1.

FIG. 4A through FIG. 4C show changes in the circuit Y2 in an open/close operation of the electrical contact device according to the second aspect of the present invention. During the operation, a predetermined voltage Vin (DC or AC) is applied between terminals E1, E2 by a power source. Also, during the operation, an input impedance or an output impedance $R_1$ or $R_2$ is placed in series with the electrical contact device. The impedances $R_1$ and $R_2$ represent impedances of a load circuit to which the power is supplied, and can vary widely depending on the configuration of the load circuit.

FIG. 4A shows an open state of the electrical contact device. In the open state, all the electrical contacts SAi, SBi are open. FIG. 2B shows a transition state of the electrical contact device. In the transition state, all the first electrical contacts SAi are open and all the second electrical contacts SB are closed. FIG. 2C shows a closed state of the electrical contact device. In the closed state, all of the electrical contacts SAi, SBi are closed.

In the open state (FIG. 4A), if the voltage Vin is applied between the terminals E1, E2, the first branch paths YAi which are parallel to each other and the second branch paths YB which are parallel to each other are under the same voltage.

With the voltage Vin being applied between the terminals E1, E2, a closing operation is now to be made, in which the first contactor which has contact portions C1*i*, C3*i* (i=1, 2, 3, . . . , m) is brought closer to the second contactor which has contact portions C2, C4 (i=1, 2, 3, . . . , n). First, as shown in FIG. 2B, all the second electrical contacts SBi come to a closed state. As a result, the second branch path YBi is passed by a current determined by the total resistance RBi. The greater the RBi is, the smaller is the current. Therefore, by making RBi sufficiently large, the current which passes the second electrical contact SBi of each second branch path YBi is made smaller than a minimum discharge current of the electrical contact SBi. This enables to appropriately reduce occurrence of arc discharge even if the second contact C2*i* bounce off the third contact portion C4 in a moment when the second electrical contact SBi closes.

In the transition state, when the closing operation is continued to bring the first contactor closer to the second contactor, all the first electrical contacts SAi come to a closed state as shown in FIG. 4C. As a result, the first branch path YAi is passed by a current determined by the total resistance RAi. The total resistance RAi of the first branch path YAi is smaller than the total resistance RBi of the second branch path YBi. Therefore, when the first electrical contact SAi is closed, the first branch path YAi is passed by a current which is greater than in the second branch path YBi. However, the voltage applied between the contacts of the first electrical contact SAi in the transition state (FIG. 2B) is smaller than in the open state (FIG. 2A), so at the moment when the first electrical contact SAi is closed, occurrence of arc discharge is reduced. The electrical contact device is adjusted so that the voltage between the contacts in the first electrical contact SAi is sufficiently small in the transition state. Such an adjustment can be made by e.g. adjusting the total resistance RBi in the second branch path YBi.

When all the electrical contacts SAi, SBi are closed, a predetermined amount of current determined by the resistances Rai, Rbi of all the branch paths YAi, YBi passes through the electrical contact device.

Now, with the electrical contact device being in the closed state, an opening operation is to be made, in which the first contactor and the second contactor move away from each other. First, as shown in FIG. 4B, all the first electrical contacts SAi come to an open state. At the moment when each first electrical contact SAi is opened, all the second electrical contact SBi are still closed, so voltage surge between the contact portions in each first electrical contact SAi is reduced. As a result, occurrence of arc discharge at the moment when each first electrical contact SAi is opened is reduced.

In the transition state, as the opening operation is continued so that the first contactor and the second contactor continue to move away from each other, all the second electrical contacts SBi also come to an open state as shown in FIG. 4A, following all the first electrical contact SAi. During this, occurrence of arc discharge is reduced for the same reason why occurrence of arc discharge is reduced at the moment when each second electrical contacts SBi is closed.

As has been described, according to the electrical contact device offered by the second aspect of the present invention, it is possible to reduce occurrence of arc discharge in the entire closing operation of the device, by closing the second electrical contacts SBi in the high-resistance second branch path YBi before closing each first electrical contact SAi in the first branch paths YAi which are the low-resistance paths for a predetermined large current to pass. Also, according to the electrical contact device offered by the second aspect of the present invention, it is possible to reduce occurrence of arc discharge in the entire opening operation of the device, by opening each second electrical contact SBi in the high-resistance second branch paths YBi after opening the first electrical contacts SAi in all the first branch paths YAi which are the low-resistance path for a predetermined large current to pass. In addition, according to the electrical contact device offered by the second aspect of the present invention, the operation as described above for suppressing arc discharge is achieved by a close-in movement and a break-away movement between the first contactor and the second contactor. An official gazette covering the Japanese Patent Application 2002-367325 discloses other technical advantages offered by electrical contact devices in which a plurality of branch paths are disposed in parallel to each other, each branch path includes electrical contacts, and these electrical contacts are opened/closed simultaneously.

In the second aspect of the present invention, preferably, all the first contact portions are spaced from their respective third contact portions by a distance greater than a distance between any of the second contact portions and their respective fourth contact portions, in an open state where all the first electrical contacts assume an open state and all the second electrical contact assume an open state. An arrangement such as this is suitable for opening and closing the first electrical contact and the second electrical contact appropriately at different timings.

Preferably, the second branch path includes a resistor which has a greater resistance than a contact resistance of the second electrical contact and is placed in series with the second electrical contact. This arrangement means that the resistor Rbi has a significant resistance value in the above-described circuit Y2.

Preferably, the second electrical contact has a contact resistance which is greater than that of the first electrical contact.

Preferably, the second contact portion and/or the fourth contact portion is made of a metal, oxide or nitride including a metal element selected from a group consisting of Ta, W, C and Mo.

Preferably, the first contactor includes: a base having a first surface and a second surface away therefrom; a plurality of projections each provided on the first surface of the base and having a tip provided by the first contact portion; and a first flat-surface electrode provided on the first surface and including the second contact portions. The second contactor has a second flat-surface electrode including the third contact portions and the fourth electrode portions contactable respectively by the tips of the projections and the first flat-surface electrode.

With the arrangement described, the transition state as shown in FIG. 4B is achieved by bringing the first contactor and the second contactor closer to each other thereby bringing the tips (the first contact portions) of all the projections into contact with the second flat-surface electrode (the third contact portions). The closed state shown in FIG. 4C is achieved by bringing the first contactor and the second contactor further closer to each other thereby achieving contact between the first flat-surface electrode (the second contact portions) and the second flat-surface electrode (the fourth contact portions). When an opening operation is made after the closed state is achieved, first the transition state as shown in FIG. 4B is achieved by moving the first contactor and the second contactor away from each other thereby separating the first flat-surface electrode from the second flat-surface electrode. As the first contactor and the second contactor are moved away further from each other, the tips of all the projections come off the flat-surface electrode, thereby achieving the open state shown in FIG. 4A.

The relative movement between the first contactor and the second contactor may be achieved by moving the first contactor relatively to the second contactor which is fixed. Alternatively, the relative movement may be achieved by moving the second contactor to the first contactor which is fixed. Still alternatively, the relative movement may be achieved by moving both of the first contactor and the second contactor.

The first contactor which includes the base and the projections can be manufactured by micromachining technology for example, in which a material substrate such as a silicon substrate is processed in etching for example. The micromachining technology enables to form an extremely large number, e.g. over 10,000, of projections simultaneously on the base. Therefore, with the micromachining technology, it is possible to form an extremely large number of the second branch paths in parallel with each other in the electrical contact device.

Preferably, the second branch path includes a resistor portion which has a greater resistance than a contact resistance of the second electrical contact and is placed in series with the second electrical contact. The resistor portion is incorporated in the base and the projections. This arrangement means that the resistor Rbi has a significant resistance value in the above-described circuit Y2.

Preferably, the base and the projections are made of silicon material, and at least the resistor portions in the base and in the projections are doped with impurity. Examples of the silicon material include monocrystal silicon, polysilicon and these doped with impurity. The base and the projections can be formed by micromachining technology for example, from a silicon substrate. In this case, an impurity such as P, As and B can be doped inside the base and projections as necessary, thereby increasing or decreasing resistance in the portion to become the resistor. In this way, a resistor portion which has a predetermined resistance value can be formed.

Preferably, the second surface of the base is provided with a common electrode for electrical connection with a plurality of the resistor portions.

Preferably, the base has a flexible structure for each of the electrical contacts for absorption of contacting force between the first contact portion and the third contact portion in a closed state of the electrical contact. In this case, preferably, the base includes cantilever beams each serving as the flexible structure, and the projections are provided on the beams. An arrangement such as this is suitable for opening and closing the first electrical contact and the second electrical contact appropriately at different timings.

BEST MODE FOR CARRYING OUT THE INVENTION

Figure 5:
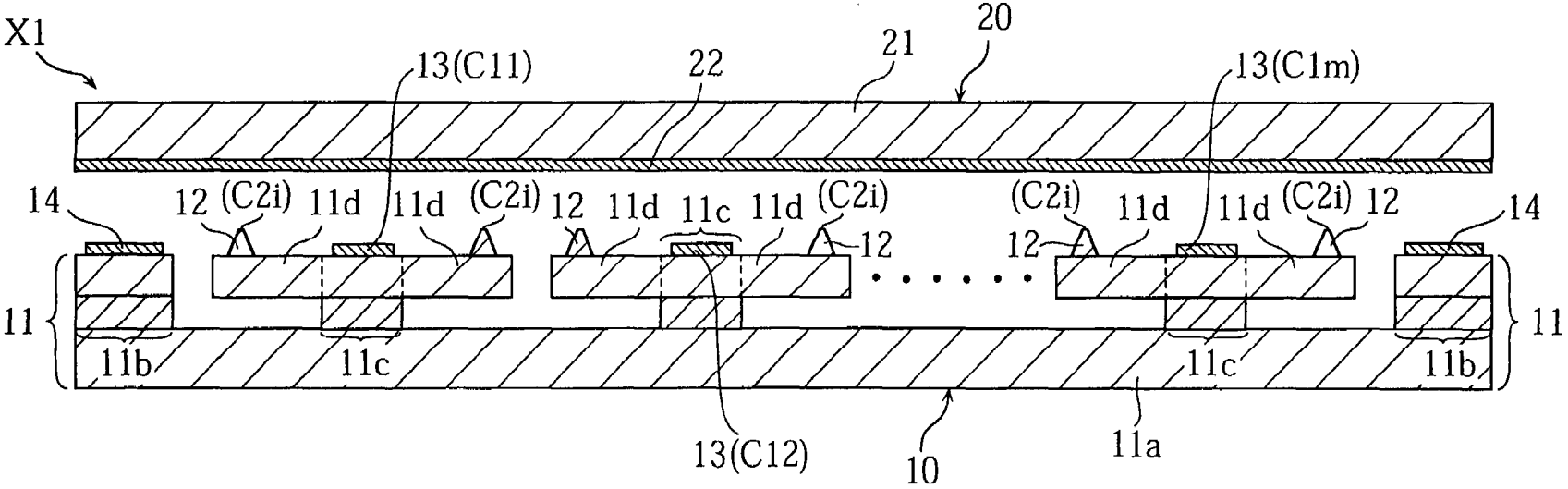
FIG. 5 shows an electrical contact device according to a first embodiment of the present invention.
Figure 6:
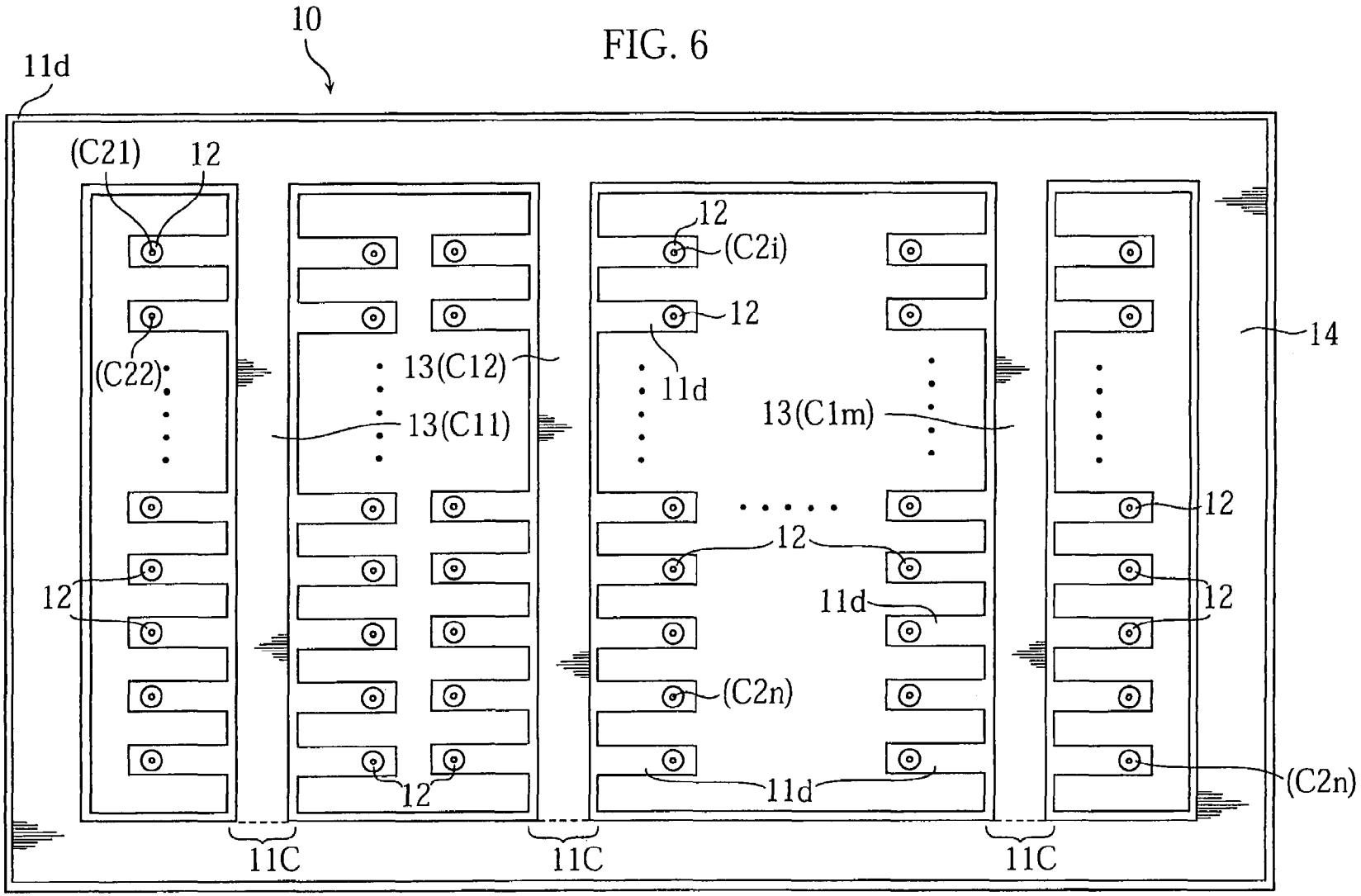
FIG. 6 is a plan view of a first contactor in the electrical contact device in FIG. 5.

FIG. 5 and FIG. 6 show an electrical contact device X1 according to a first embodiment of the present invention. The electrical contact device X1 includes a first contactor 10 and a second contactor 20. The first contactor 10 has a base 11, a plurality of projections 12, a plurality of flat electrodes, and wiring 14.

The base 11 has a rear portion 11*a*, a frame 11*b*, a plurality of common fixed portions 11*c* and a plurality of beams 11*d*. As will be described later, these are formed by micromachining technology, integrally from a single material substrate which has a predetermined laminate structure.

The rear portion 11*a* provides rigidity to the first contactor 10 or the base 11.

The frame 11*b* is formed on a fringe portion of the rear portion 11*a*.

The common fixed portions 11*c* lay in parallel to each other on the rear portion 11*a*. Each of the beams 11*d* has its one end fixed onto one of the common fixed portions 11*c*. In other words, the beams 11*d* have a cantilever structure. The beams 11*d* are parallel with each other. Note that in FIG. 5, the common fixed portion 11C and the beam 11D are bordered by broken lines for the sake of clarity. In FIG. 6, part of the common fixed portions 11*c* and beams are not illustrated for clarity.

As shown in FIG. 6, the projections 12 are disposed in two dimensional arrays, and in the present embodiment, each of the projections 12 is generally conical and is placed on one of the beams 11*d*. The number of projections disposed is 100 through 100,000 for example. Corresponding to the number of projections 12, the number of beams 11*d* will also be 100 through 100,000. Measuring from the base 11, the projections 12 have a height of 1 μm through 300 μm for example, and the cone has a base diameter of 1 μm through 300 μm. It is preferable that the height of the projections 12 is generally the same as the bottom diameter. The projections 12 may have their surfaces coated with a high-melting-point, high-boiling-point metal such as W and Mo.

At least an upper portion of the common fixed portions 11*c*, the beams 11*d*, and the projections 12 are made of a single material which has a predetermined electrical conductivity.

The flat electrodes 13 is made of an electrically conductive material whose electric resistance is lower than that of the upper portion of the common fixed portions 11*c*, the beams 11*d* and the projections 12, and has a thickness of 0.5 μm through 2 μm for example. Each of the flat electrodes 13 is on one of the common fixed portions 11*c*. The flat electrodes 13 lay in parallel to each other. In the present embodiment, the flat electrodes 13 can serve as wiring for supplying power to the beams 11*d* and the projections 12.

The wiring 14 is on the frame 11*b*, and is made from a single film of metal integrally with the flat electrodes 13. In FIG. 6, a metal film pattern formed on the frame 11*b* and common fixed portions 11*c* is bordered into the flat electrodes 13 and the wiring 14 in broken lines.

The second contactor 20 includes a substrate 21 and a common flat electrode 22. The substrate 21 is a silicon substrate for example. The common flat electrode 22 is preferably made of a high-melting-point, high-boiling-point metal such as W and Mo. If sufficient protection against electrical discharge is provided for the projections 12 by coating the projections 12 with a high-melting-point metal for example, then the common flat electrode 22 may be made of a low-resistance metal selected from a group consisting of Cu, Au, Ag, Pd and Pt, or of an alloy thereof. In the present invention, the second contactor 20 may alternatively made entirely of a metal selected from those listed above for the common flat electrode 22.

FIG. 7A through FIG. 9D show steps for manufacturing the first contactor 10 of the electrical contact device X1. These steps are an example of methods for making the first contactor 10 by micromachining technology. Throughout FIG. 7A to FIG. 9D, a process of forming the first contactor 10 will be shown in a series of illustrative sectional views.

Figure 7A:
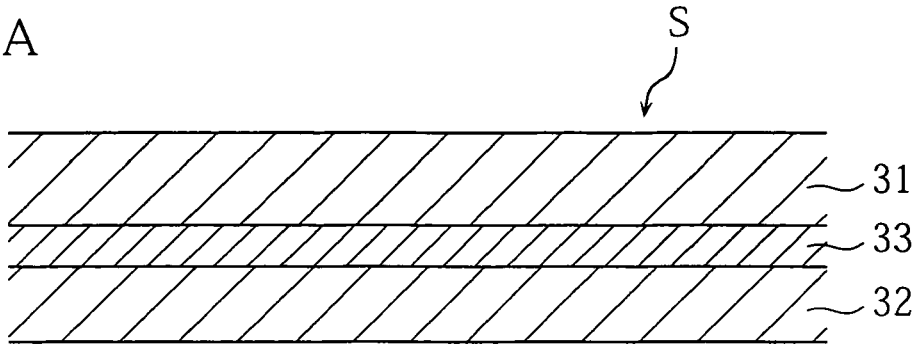
FIG. 7A through FIG. 7D show a few steps in a method of making the first contactor of the electrical contact device in FIG. 5.

In the manufacture of the first contactor 10, first, the substrate S as shown in FIG. 7A is prepared. The substrate S an SOI (Silicon-on-Insulator) substrate for example, and has a laminate structure including a first layer 31, a second layer 32 and an intermediate layer 33 sandwiched thereby. In the present embodiment, the first layer 31 has a thickness of 20 μm, the second layer 32 has a thickness of 200 μm, and the intermediate layer 33 has a thickness of 2 μm, for example.

The first layer 31 and the second layer 32 are made of silicon material and are rendered electrically conductive as necessary, by doping with e.g. an n-type impurity such as P and As. Alternatively, electrical conductivity may be given by a p-type impurity such as B. Further, doping may be made with both of the n-type and the p-type impurities whereby at least a predetermined part of the silicon material may be given an increased resistance.

The intermediate layer 33 is made of an insulating substance in the present embodiment. Examples of the insulating substance include silicon oxide and silicon nitride. The intermediate layer 33 provided by an insulating substance enables good electric isolation of the beams 11*d* and the projections 12, from the rear portion 11*a* as they are formed in the substrate S. However, the intermediate layer 33 may be made of electrically conductive substance in the present invention. In this case, it becomes possible not to use the flat electrodes 13 as a power supply wiring to the beams 11*d* and the projections 12, but to provide such a power supply wiring on the rear portion 11*a*.

Figure 7B:
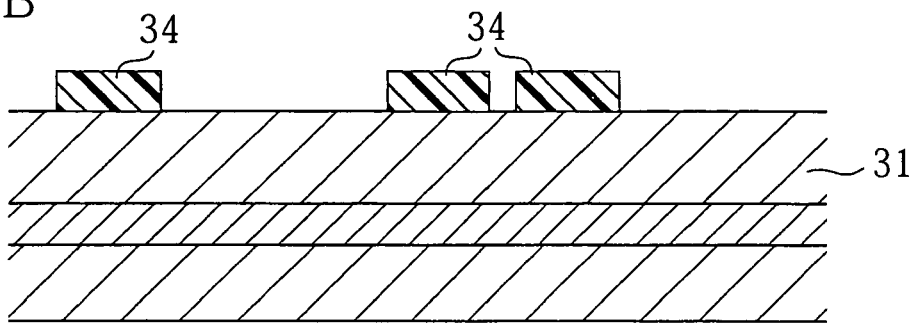

Next, as shown in FIG. 7B, a resist pattern 34 is formed on the first layer 31 for formation of the projections 12. Specifically, a liquid photoresist is spin-coated on the silicon substrate S, and then the film is patterned through an exposure process and a development process, to obtain the resist pattern 34. Masks included in the resist pattern 34 are circular, to the shape of the target forms or the projections 12. The diameter of the circular masks should preferably be about two times of the height of the projections 12.

Examples of the photo-resist include AZP 4210 (made by Clariant Japan) and AZ 1500 (made by Clariant Japan). Other resist patterns to be described later are also formed through the same steps of photo-resist film formation, exposure process and development process performed thereafter.

Figure 7C:
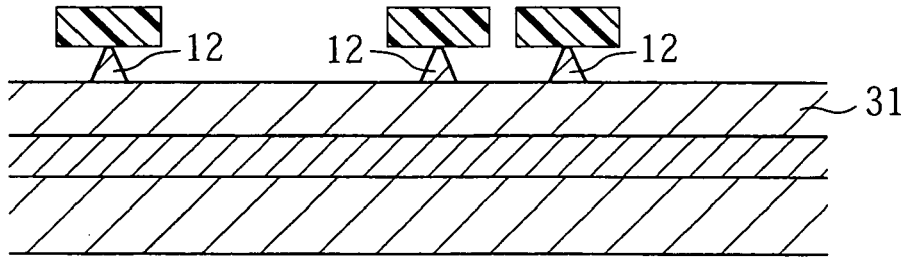

Next, using the resist pattern 34 as a mask, isotropic etching is performed to the first layer 31 until a predetermined depth is achieved. The etching can be reactive ion etching (RIE) As a result of the etching, a plurality of projections 12 are formed as shown in FIG. 7C. For clarity reasons, a border surface between the projections 12 and the material below them is shown in a solid line.

Figure 7D:
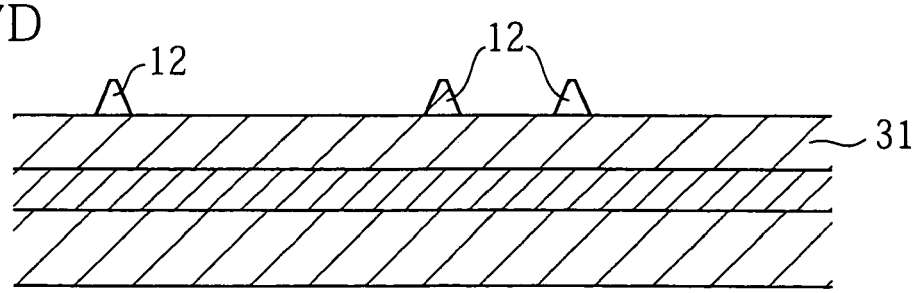

Next, as shown in FIG. 7D, a remover solvent is used for example, to remove the resist pattern 34 from the first layer 31. An example of usable removers is AZ Remover 700 (made by Clariant Japan). This remover is also usable in another removal operation of a resist pattern to be described later.

Figure 8A:
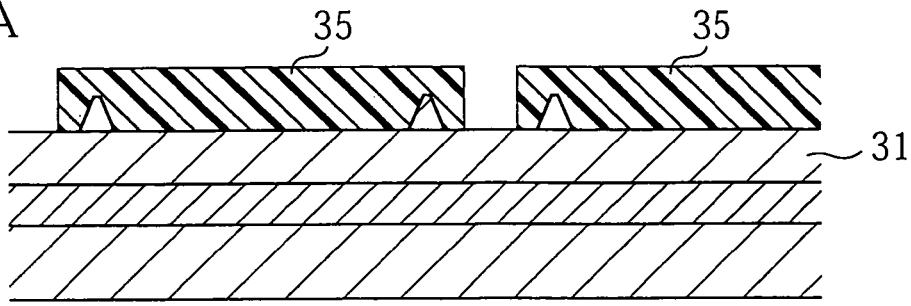
FIG. 8A through FIG. 8D show steps that follow the step in FIG. 7D.

Next, as shown in FIG. 8A, a resist pattern 35 is formed on the first layer 31. The resist pattern 35 serves as a mask on the first layer 31 to mask regions to be the frame 11*b*, the common fixed portions 11*c* and the beams 11*d*, and covers the projections 12.

Figure 8B:
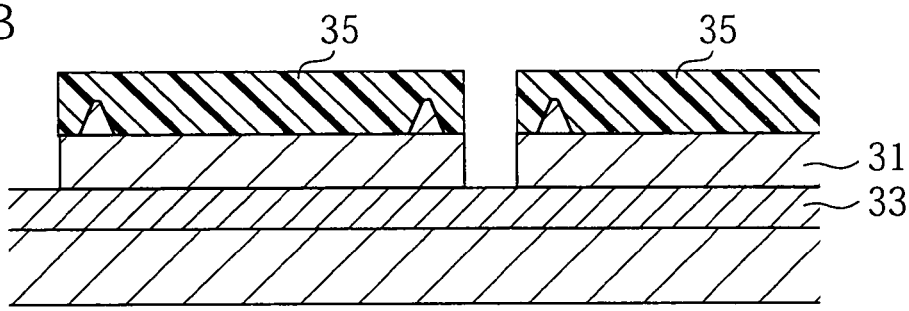

Next, as shown in FIG. 8B, anisotropic etching is performed using the resist pattern 35 as a mask, until the first layer 31 is etched to the intermediate layer 33. An example of usable anisotropic etching is Deep-RIE.

Figure 8C:
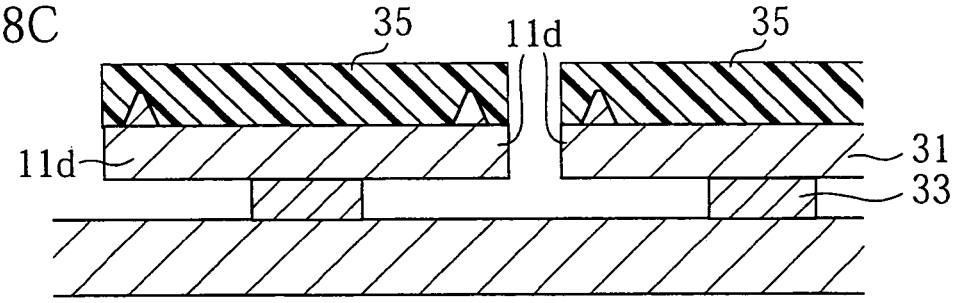
Figure 8D:
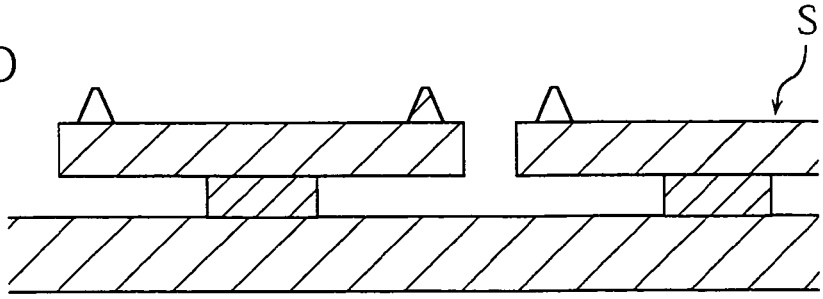

Next, as shown in FIG. 8C, the intermediate layer 33 below the beams 11*d* is removed by wet etching. If the intermediate layer 33 is made of silicon oxide, an example of the etchant is hydrofluoric acid. In this etching step, undercuts are formed below the beams 11*d* which are coated with the resist pattern 35. This step yields outlines of the frame 11*b*, common fixed portions 11*c* and beams 11*d*. Thereafter, as shown in FIG. 8D, the resist pattern 35 is removed from the substrate S.

Figure 9A:
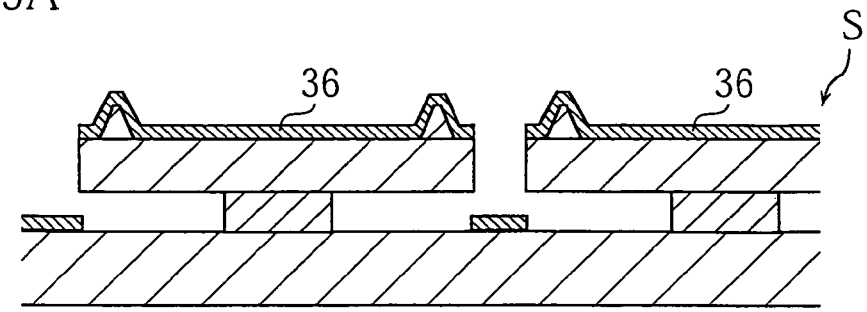
FIG. 9A through FIG. 9D show steps that follow the step in FIG. 8D.
Figure 9B:
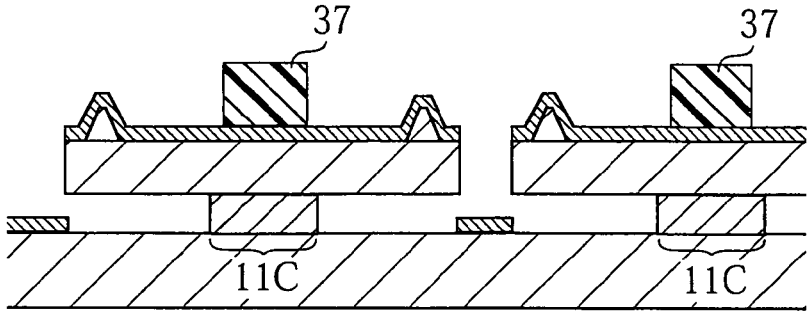

Next, as shown in FIG. 9A, a vapor deposition method for example is used to form a metal film 36 on the substrate S. Metal with sufficiently smaller resistance than that of Si can be used, such as Au, Cu, and Al, for example. Next, as shown in FIG. 9B, a resist pattern 37 is formed on the common fixed portions 11*c*. The resist pattern 37, which is also formed on the frame 11*b*, masks regions on the metal film 36 which are to become the flat electrodes 13 and the wiring 14.

Figure 9C:
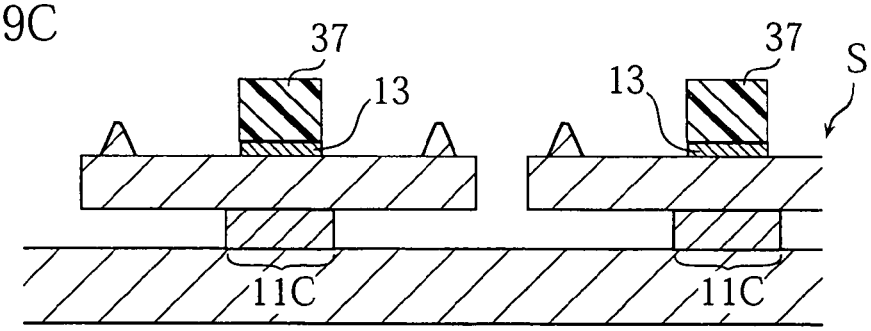
Figure 9D:
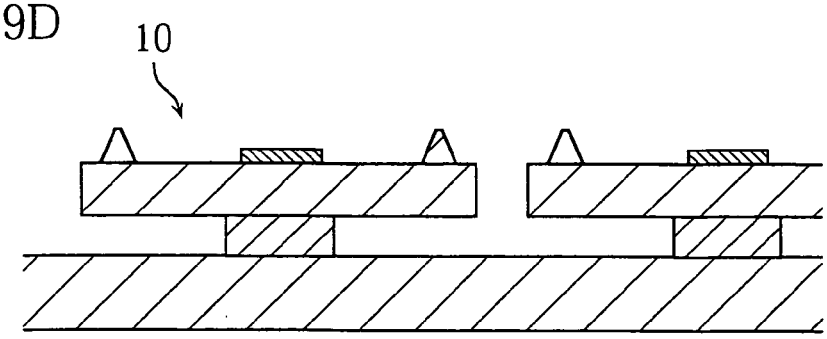

Next, using the resist pattern 37 as a mask, wet etching is performed to the metal film 36, to form the flat electrodes 13 as shown in FIG. 9C. In this step, the wiring 14 is formed on the frame 11*b*. The etchant is selected from those which do not unduly etch the silicon material, etc. Thereafter, as shown in FIG. 9D, the resist pattern 37 is removed from the substrate S. The sequence of steps shown in FIG. 7A through FIG. 9D yield the first contactor 10 of the electrical contact device X1.

On the other hand, the second contactor 20 can be made by vapor-depositing a predetermined metal onto the substrate 21 thereby forming the common flat electrode 22. Alternatively, the second contactor 20 may be made by bonding a sheet or a foil of predetermined metal to the substrate 21 thereby forming the common flat electrode 22.

The first contactor 10 and the second contactor 20 are movable relatively to each other, so that they can achieve a closing operation in which they come closer and an opening operation in which they move away from each other. The relative movement between the first contactor 10 and the second contactor 20 is achieved by moving the first contactor 10 relatively to the second contactor 20 which is fixed. Alternatively, the relative movement may be achieved by moving the second contactor 20 to the first contactor 10 which is fixed. Still alternatively, the relative movement may be achieved by moving both of the second contactor 20 and the first contactor 10. As the driving means for the first contactor 10 and/or the second contact 20, an actuator with an electromagnet can be used like one used in a conventional relay as the driving means for the movable portion.

Figure 1:
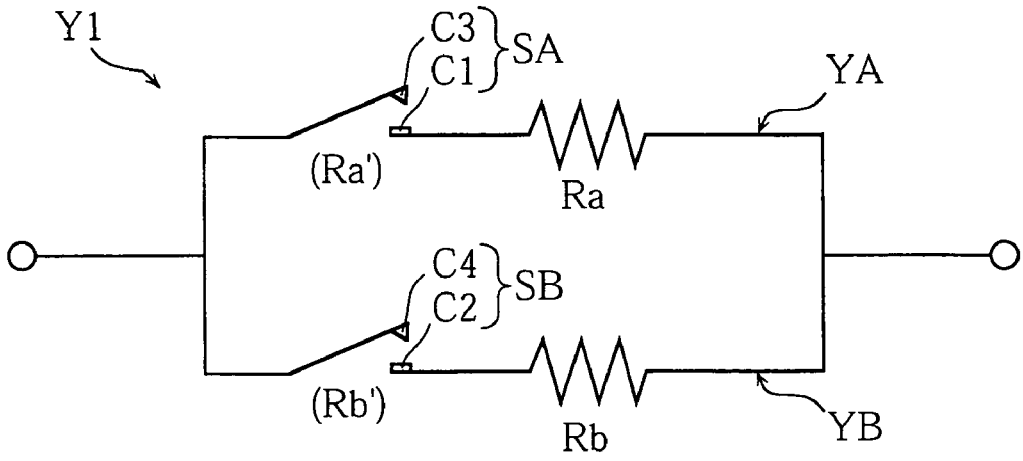
FIG. 1 is an electric diagram of an electrical contact device according to a first aspect of the present invention.
Figure 3:
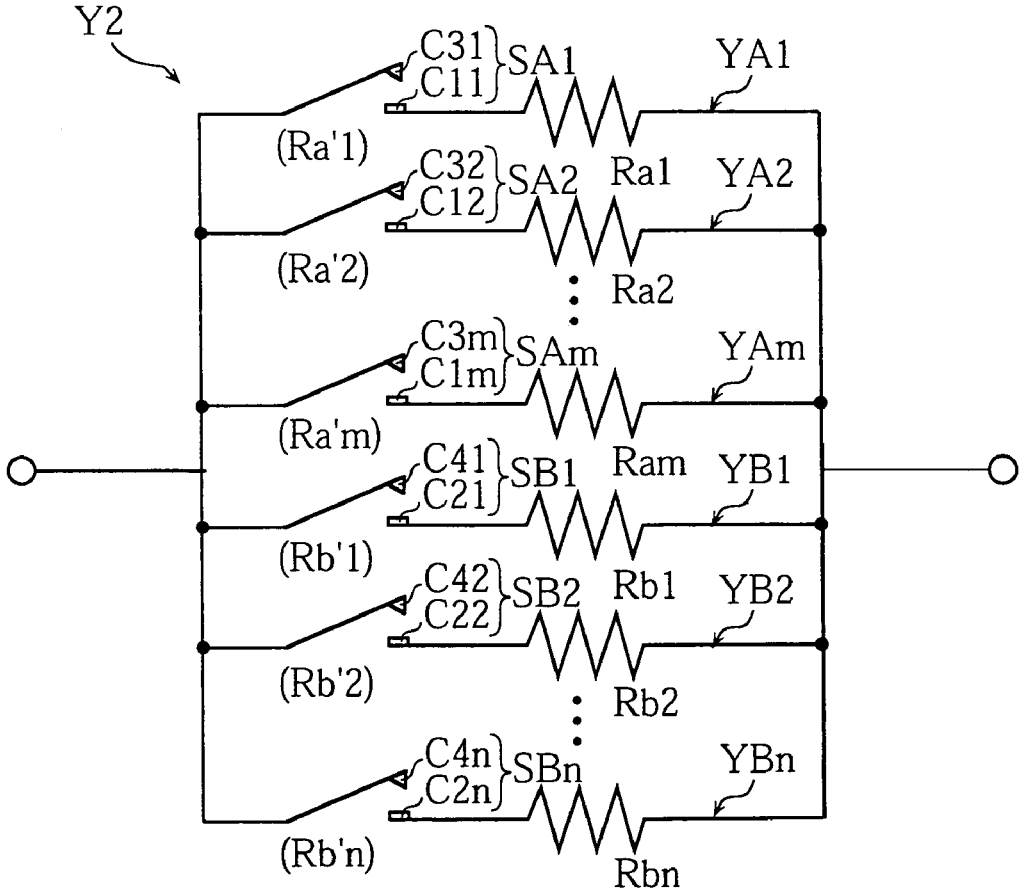
FIG. 3 is an electric diagram of an electrical contact device according to a second aspect of the present invention.
Figure 2A:
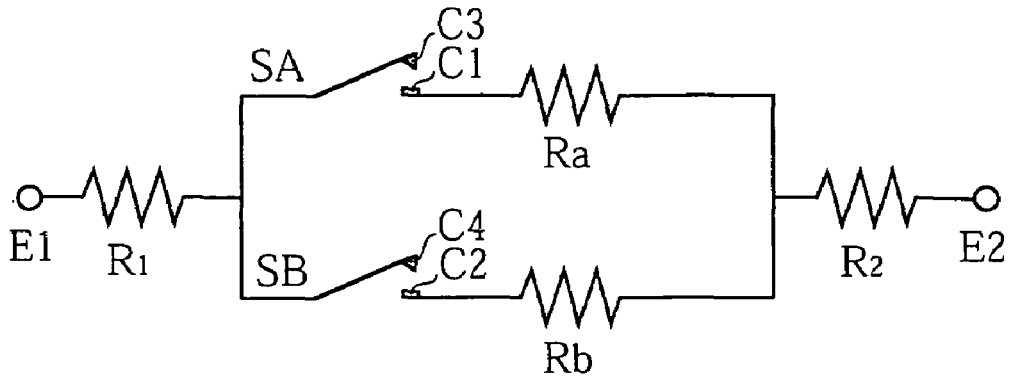
FIG. 2A through FIG. 2C show circuitry changes in an open/close operation of the electrical contact device according to the first aspect of the present invention.
Figure 2B:
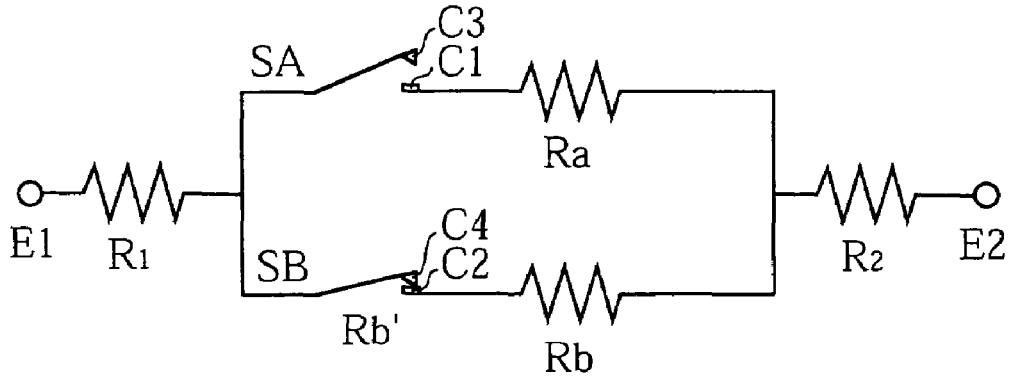
Figure 2C:
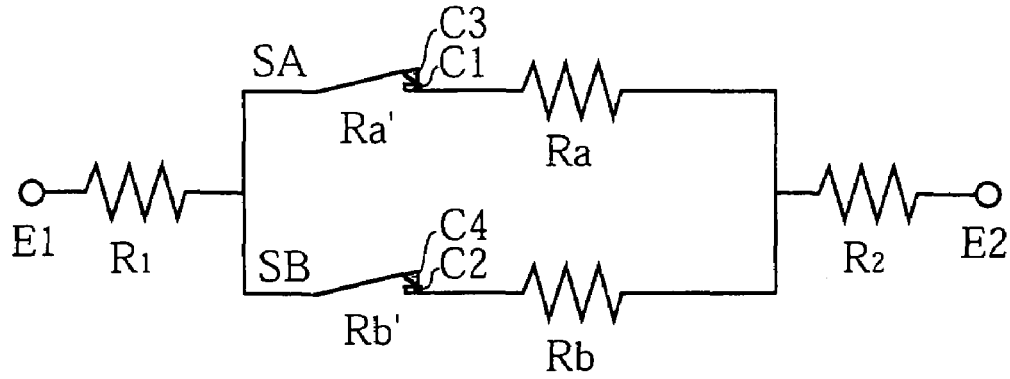

With such a configuration, an electrical contact device X1 is provided with electrical circuit Y2 as shown in FIG. 3. Specifically, each flat electrode 13 serves as a first contact C1*i* in the circuit Y2. Each spot on the common flat electrode 22 which faces one of the flat electrodes 13 serves as a third contact C3*i*. Therefore, each flat electrodes 13, and each spot on the common flat electrode 22 which faces a corresponding one of the flat electrodes 13 serve as a first electrical contact SAi, with their contact resistance being represented by Ra'i. An internal resistance of the flat electrodes 13 and wiring 14 is represented by a resistance Rai. In the present embodiment, the resistance Rai is substantially 0 ohm.

A tip of each projection 12 in the first contactor 10 is represented by a second contact C2*i* in the circuit Y2. Each spot on the common flat electrode 22 which faces a corresponding one of the projections 12 is represented by a fourth contact C4*i*. Therefore, the tip of each projection 12, and the spot in the common flat electrode 22 which faces a corresponding one of the projections 12 serve as a second electrical contact SBi, with their contact resistance being represented by Rb'i. A portion starting from the tips of the projections 12 through the beams 11*d* to the flat electrodes 13 is represented by a resistor Rbi.

Figure 10A:
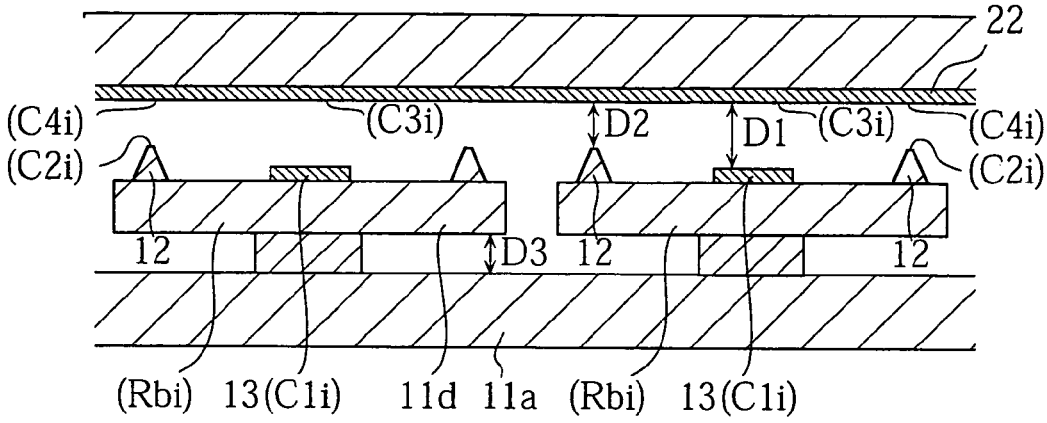
FIG. 10A through FIG. 10C show an opening and a closing process of the electrical contact device in FIG. 5.
Figure 10B:
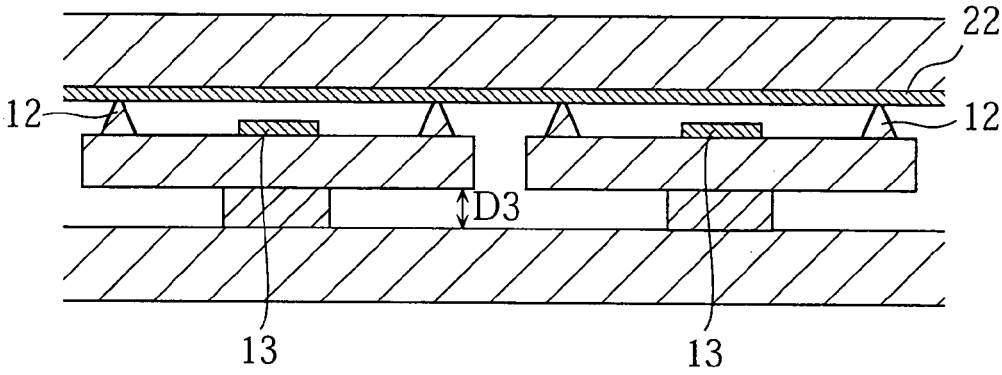
Figure 10C:
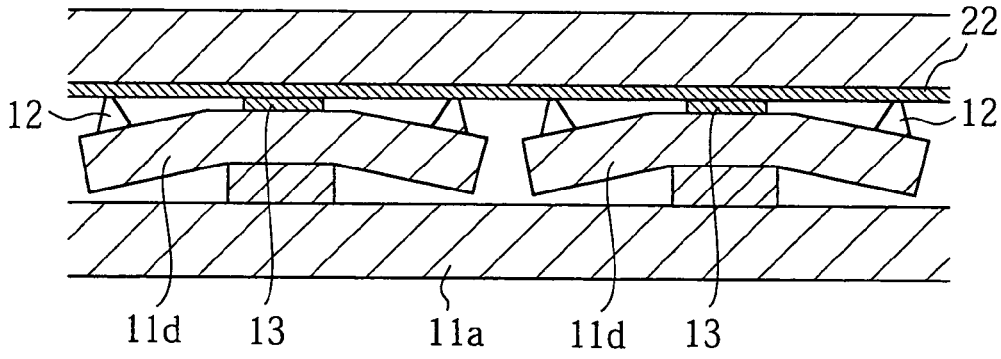

FIG. 10A through FIG. 10C show an open/close process in the operation of electrical contact device X1. As has been described with reference to FIG. 4A through FIG. 4C, when the electrical contact device X1 is operating, a predetermined load is connected in series with the electrical contact device X1, and a predetermined voltage Vin is applied to the load through the electrical contact device X1.

Figure 4A:
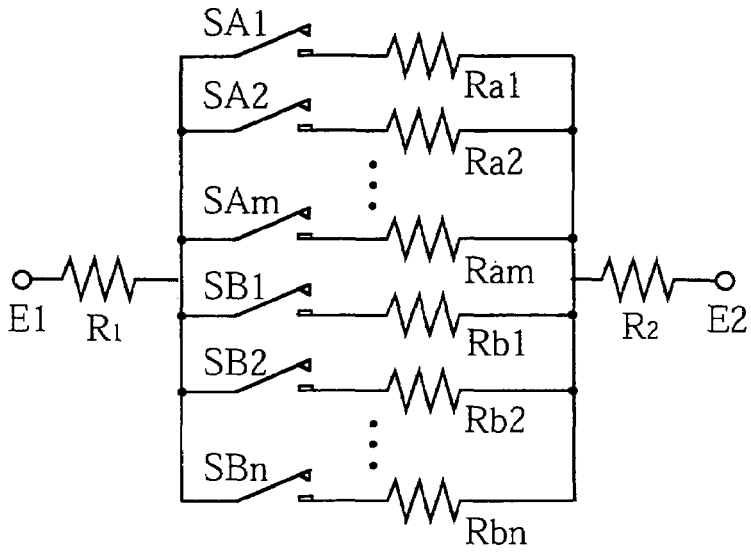
FIG. 4A through FIG. 4C show circuitry changes in an open/close operation of the electrical contact device according to the second aspect of the present invention.

When the electrical contact device X1 is opened, the first contactor 10 and the second contactor 20 are arranged as shown in FIG. 10A. All the projections 12 and all the flat electrodes 13 are spaced from the common flat electrode 22. In other words, as shown in FIG. 4A, all the first electrical contacts SAi (i=1, 2, 3 . . . , m) and all the second electrical contacts SBi (i=1, 2, 3 . . . , n) are in the open state. Therefore, no current flows to the load circuit (an unillustrated target circuit in which current is to flow) in the open state.

In the open state, when the flat electrodes 13 and the common flat electrode 22 are spaced by a distance D1 whereas the projections 12 and the common flat electrode 22 are spaced by a distance D2, the relationship between D1 and D2 can be described as: D1>D2.

From this open state, a closing operation is now made so that the first contactor 10 and the second contactor 20 come closer. First, all the projections 12 make contact with the common flat electrode 22, closing all the second electrical contacts SBi, which brings the electrical contact device X1 to a transition state as shown in FIG. 10B. In this state, a second branch path YBi, which has the second electrical contacts SBi, has a sufficiently large Rbi and therefore has a sufficiently large total resistance RBi. Thus, occurrence of arc discharge at the moment when the projections 12 make contact with the common flat electrode 22 is appropriately reduced. During a momentary period in which the electrical contact device X1 is in the transition state, all the second electrical contacts SBi provide paths for the current, whereby a small amount of current flows through the entire electrical contact device X1.

After the transition state, as the closing operation is continued so that the first contactor 10 and the second contactor 20 continue to come closer to each other, all the projections 12 keep contact with the common flat electrode 22 thereby maintaining all the second electrical contacts SBi in the closed state, and in addition all the flat electrodes 13 make contact with the common flat electrode 22, closing all the first electrical contacts SAi, bringing the electrical contact device X1 into a fully closed state as shown in FIG. 10C. In the transition state (FIG. 10B), a voltage between two contacts C1*i*, C3*i* of the first electrical contact SAi is smaller than in the open state (FIG. 10A). Thus, occurrence of arc discharge at the moment when the common electrode 13 makes contact with the common flat electrode 22 is appropriately reduced. The electrical contact device X1 is so adjusted that the voltage between two contacts in the first electrical contact SAi is sufficiently small in the transition state.

In the closed state, the current passes through all the first electrical contacts SAi and all the second electrical contacts SBi, i.e. a large amount of current necessary for the load circuit passes through the entire electrical contact device X1.

Further, in the closed state, the beams 11*d* flex as shown in FIG. 10C. In the open state, the beams 11*d* are spaced from the rear portion 11*a* by a distance D3. In order for the beams 11*d* to flex sufficiently in the closed state, the distance D3 must be sufficiently larger than D1−D2.

Thereafter, an opening operation is performed, so that the first contactor 10 and the second contactor 20 in the closed state move away from each other. First, all the projections 12 move away from the common flat electrode 22, bringing the electrical contact device X1 into the transition state as shown in FIG. 10B. At the moment when each of the first electrical contacts SAi opens, all the second electrical contacts SBi are still in the closed state. Therefore, voltage surge between contacts in each of the first electrical contacts SAi is reduced. As a result, occurrence of arc discharge is reduced at the moment when each of the first electrical contacts SAi opens. During a momentary period in which the electrical contact device X1 is in the transition state, all the second electrical contacts SBi provide paths for the current, whereby a small amount of current flows through the entire electrical contact device X1.

After the transition state such as the above, as the opening operation is continued so that the first contactor 10 and the second contactor 20 continue to come apart from each other, all the projections 12 come off the common flat electrode 22, and the electrical contact device X1 comes to the open state as shown in FIG. 10A. During this, occurrence of arc discharge at the moment when the projections 12 come off the common flat electrode 22 is appropriately reduced for the same reason why occurrence of arc discharge is reduced at the moment when each of the second electrical contacts SBi closes.

Figure 11:
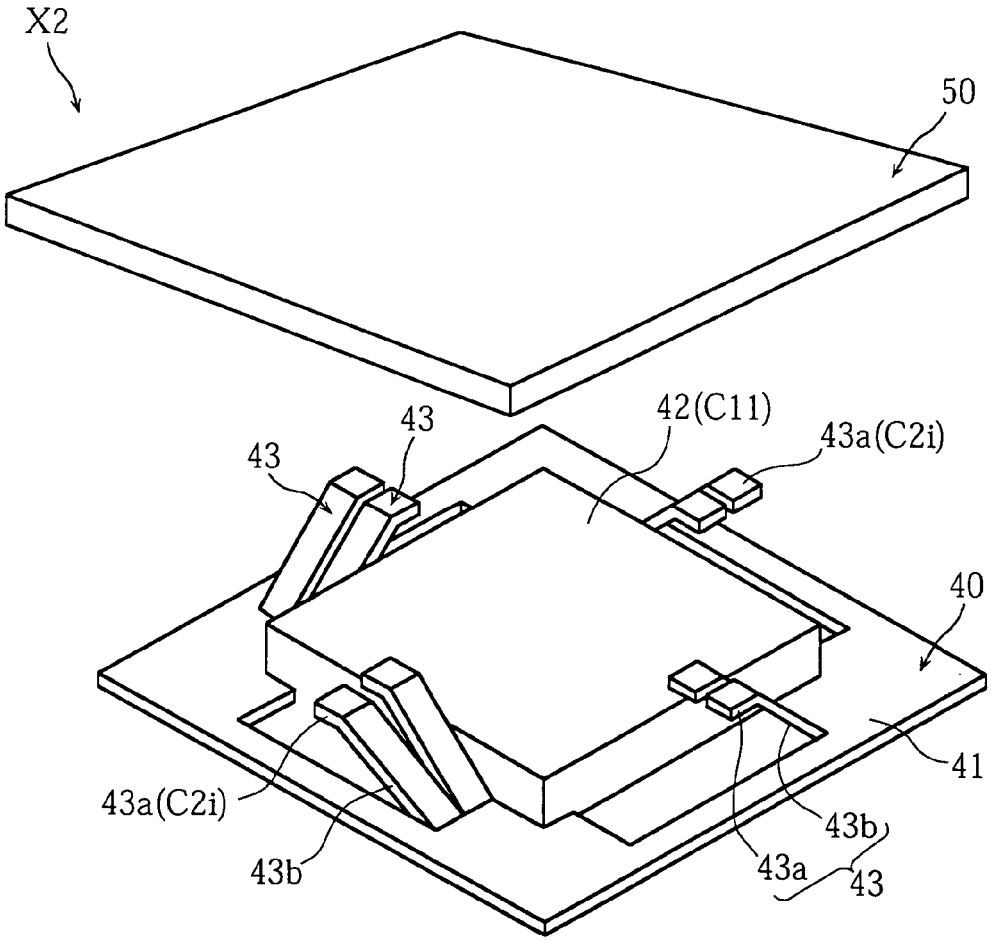
FIG. 11 shows an electrical contact device according to a second embodiment of the present invention.
Figure 12:
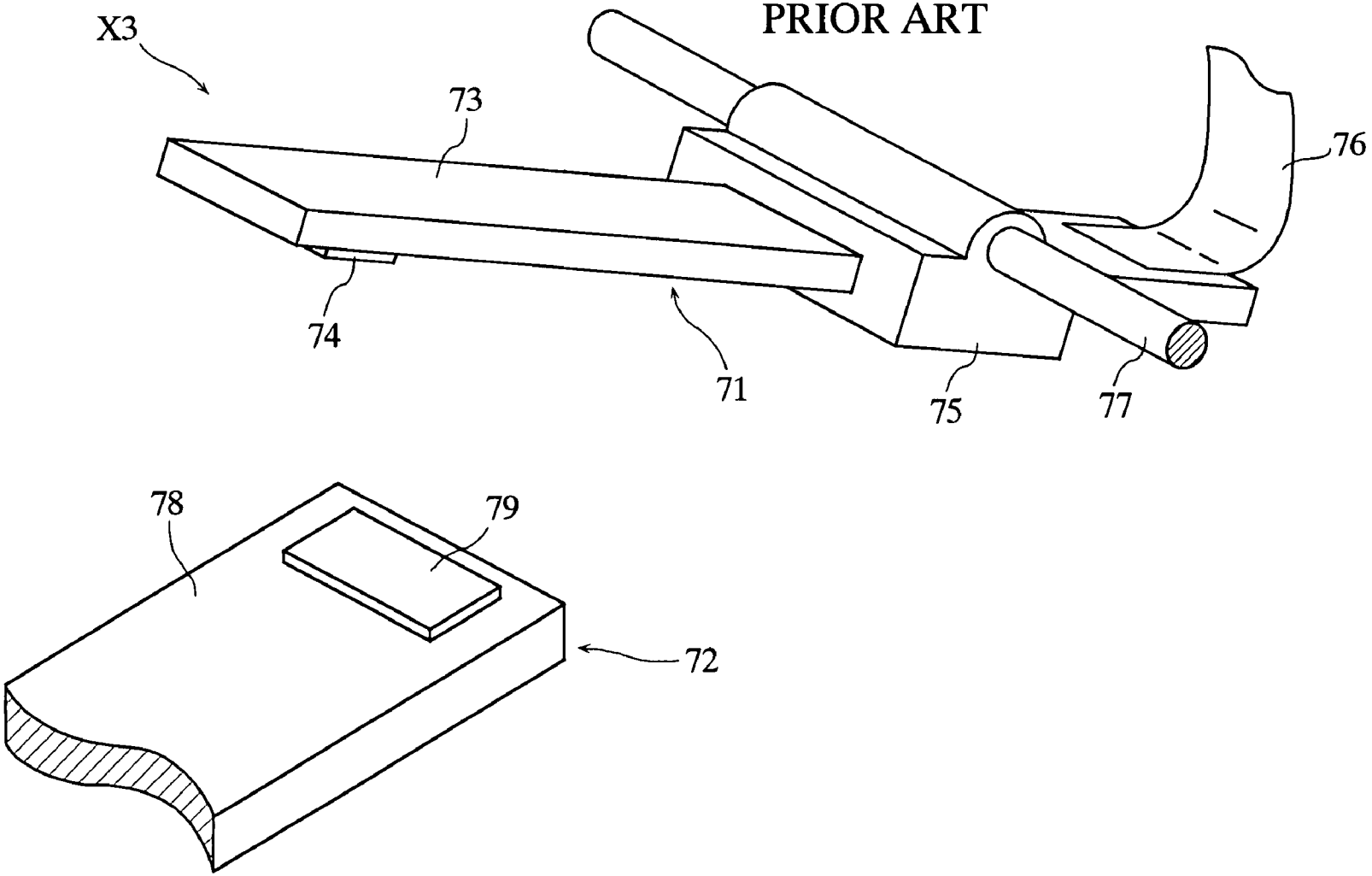
FIG. 12 PRIOR ART
FIG. 12 shows a conventional electrical contact device which assumes an open state.
Figure 13:
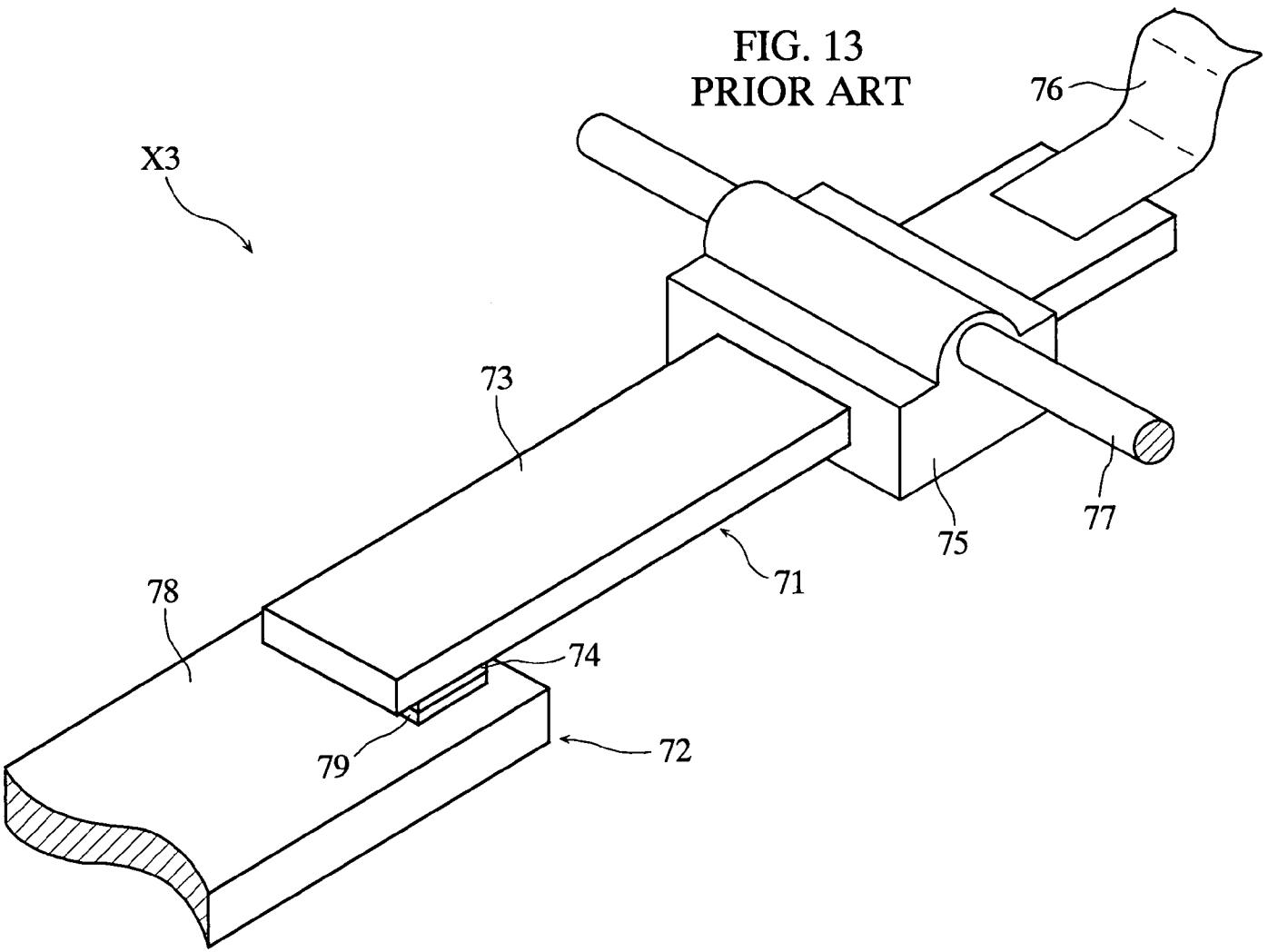
FIG. 13 PRIOR ART
FIG. 13 shows the conventional electrical contact device in FIG. 12 which assumes a closed state.
Figure 14:
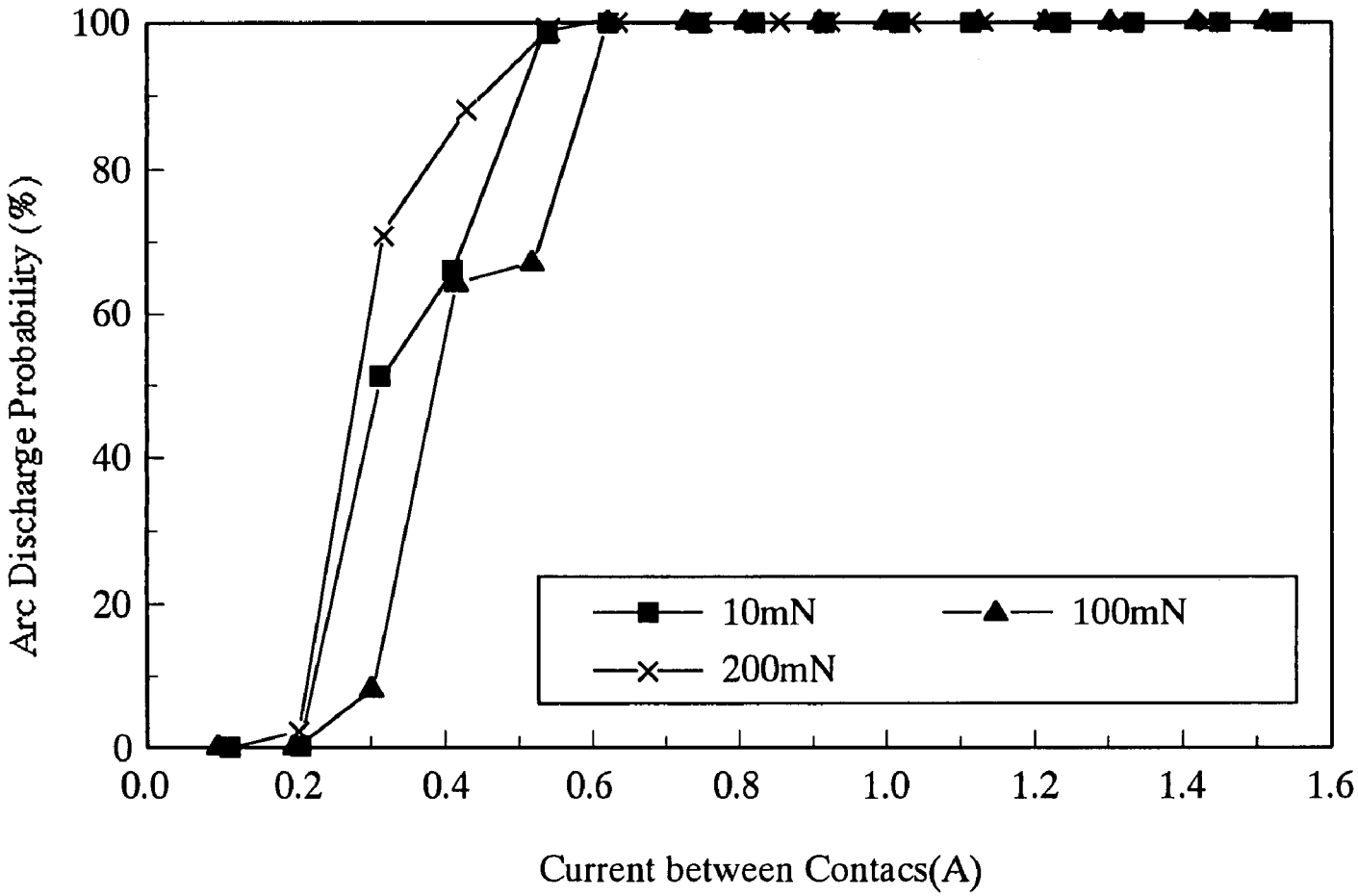
FIG. 14 PRIOR ART
FIG. 14 is a graph showing an example of dependency of arc discharge probability on electric current which passes through contacts.

FIG. 11 shows an electrical contact device X2 according to a second embodiment of the present invention. The electrical contact device X2 includes a first contactor 40 and a second contactor 50.

The first contactor 40 has a base 41, a fixed electrode 42 and spring electrodes 43. These parts in the first contactor 40 are formed from a single silicon substrate, by micromachining technology for example.

The base 41 serves as a base member of the first contactor 40. The fixed electrode 42 has at least its surface made of metal, and serves as an electrode. Examples of the metal which provides the surface of the fixed electrode 42 include silver and silver alloys.

The electrical contact device X2 according to the present embodiment has eight of the spring electrodes 43 around the fixed electrode 42. Each of the spring electrodes 43 has a contact face 43*a* and a stem 43*b*. The base 41 and all of the spring electrodes 43 are formed integrally out of a single silicon material, and each end of the stems 43*b* which is closer to the base 41 is elastically deformable. The stems 43*b* serve as a predetermined resistor. The surface of the contact faces 43*a* is coated with a high-melting-point metal such as W and Mo. The spring electrodes 43 constructed as the above protrude out of the base 41 to above the fixed electrode 42 as in the figure, under a natural state.

At least the surface of the fixed electrode 42, and the spring electrodes 43 are electrically connected with a common electrode (not illustrated) which is on the back surface of the base 41.

The second contactor 50 is a metal plate of a low-resistance metal such as Au, Cu and Al.

The first contactor 41 and the second contactor 42 are movable relatively to each other, so that they can achieve a closing operation in which they come closer, and an opening operation in which they move away from each other. The relative movement between the first contactor 40 and the second contactor 50 is achieved by moving the first contactor 40 relatively to the second contactor 50 which is fixed. Alternatively, the relative movement may be achieved in a different mode of relative movement as mentioned earlier in the first embodiment. The first contactor 40 and/or the second contactor 50 can be moved just in the same way as described for the first embodiment.

The electrical contact device X2 constructed as the above embodies a circuit Y2 as shown in FIG. 3. Specifically, the fixed electrode 42 serves as a first contact C11 in the circuit Y2 whereas the spot in the second contactor which faces the fixed electrode 22 serves as a third contact C31. Therefore, the fixed electrode 42, and the spot on the second contactor which faces the fixed electrodes 42 constitute a single first electrical contact SAi, with its contact resistance being represented by Ra'1. An internal resistance of the fixed electrode 42 is represented by a resistor Ra1. In the present embodiment, the resistance Rai is substantially 0 ohm.

The contact face 43*a* of each spring electrode 43 in the first contactor 40 is represented by a second contact C2*i* in the circuit Y2. Each spot on the second contactor 50 which faces a corresponding one of the contact face 43*a* constitute a second electrical contact SBi, with their contact resistance being represented by Rb'i. The stems 43*b* of the spring electrode 43 are represented by a resistor Rbi.

Figure 4B:
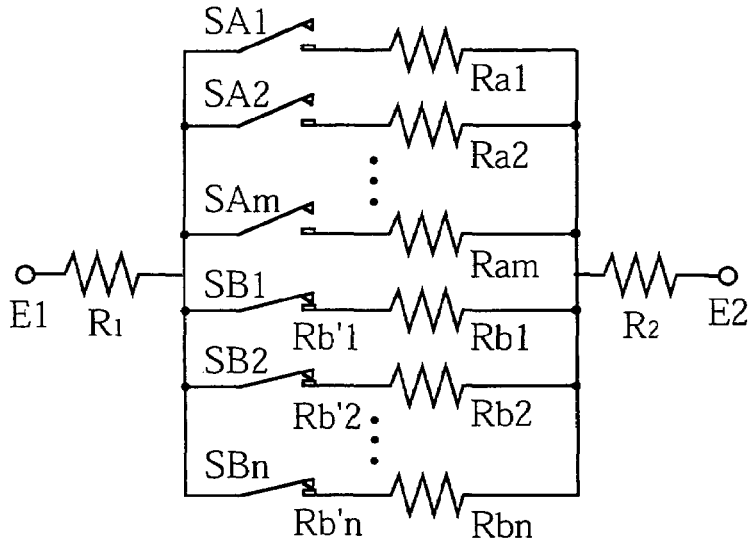

As has been described with reference to FIG. 4A through FIG. 4C, when the electrical contact device X2 is operating, a predetermined load is connected in series with the electrical contact device X2, and a predetermined voltage Vin is applied to the load through the electrical contact device X2.

When the electrical contact device X2 is in its open state (FIG. 4A), the fixed electrode 42 and all the contact faces 43*a* of the spring electrodes 43 are spaced from the second contactor 50. In other words, the first electrical contact SA1 and all the second electrical contacts SBi (i=1, 2, 3 . . . , 8) are in the open state. Therefore, no current flows to the load circuit (an unillustrated target circuit to which the power is to be supplied) in the open state. In the open state as described, the distance between the fixed electrode 42 and the second contactor 50 is greater than the distance between the contact face 43*a* and the second contactor 50.

From this open state, a closing operation is now made so that the first contactor 40 and the second contactor 50 come closer. First, the contact faces 43*a* of all the spring electrodes 43 make contact with the second contactor 50, closing all the second electrical contacts SBi, which brings the electrical contact device X2 to a transition state (FIG. 4B). In this state, a second branch path YBi, which has the second electrical contacts SBi, has a sufficiently large Rbi and therefore has a sufficiently large total resistance RBi. Thus, occurrence of arc discharge at the moment when the contact faces 43*a* make contact with the second contactor 50 is appropriately reduced. During a momentary period in which the electrical contact device X2 is in the transition state, all the second electrical contacts SBi provide paths for the current, whereby a small amount of current flows through the entire electrical contact device X2.

Figure 4C:
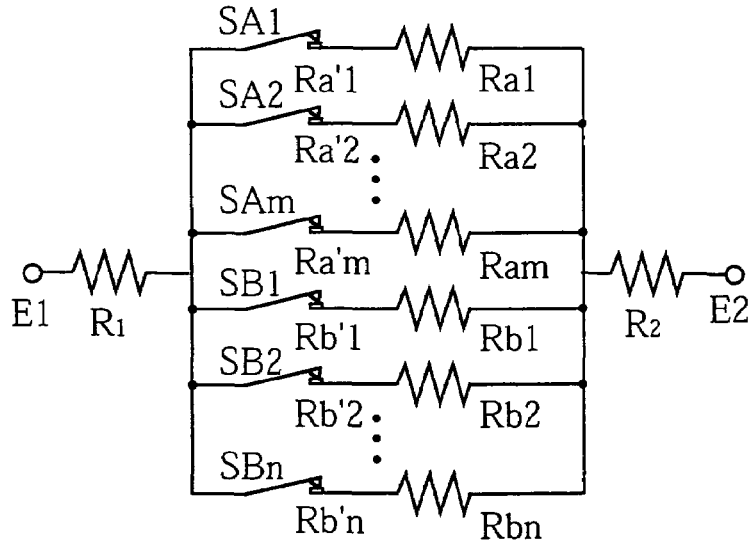

After the transition state, as the closing operation is continued so that the first contactor 40 and the second contactor 50 continue to come closer to each other, the electrical contact device X2 eventually comes to the closed state (FIG. 4C). Specifically, the fixed electrode 42 keeps contact with the second contactor 50 thereby maintaining all the second electrical contacts SBi in the closed state, and in addition the first electrical contact SAi comes to the closed position. In the transition state (FIG. 4B), a voltage between the fixed electrode 42 and the second contactor 50 is smaller than in the open state (FIG. 4A). Thus, occurrence of arc discharge at the moment when the fixed electrode 42 makes contact with the second contactor 50 is appropriately reduced. The electrical contact device X2 is so adjusted that in the transition state the voltage between the fixed electrode 42 and the second contactor 50 is sufficiently small.

In the closed state, the current passes through the first electrical contacts SA1 and all the second electrical contacts SBi, i.e. a large amount of current necessary for the load circuit passes through the entire electrical contact device X1. Note that in the closed state, base portions of the stems 43*b* in the spring electrodes 43 make flexion with respect to the base 41.

Thereafter, an opening operation is performed, so that the first contactor 40 and the second contactor 50 in the closed state move away from each other. First, the fixed electrode 42 moves away from the second contactor 50, i.e. the first electrical contact SA1 assumes the open state, bringing the electrical contact device X2 into the transition state (FIG. 4B). At the moment when the first electrical contacts SA1 opens, all the second electrical contacts SBi are still in the closed state. This reduces a voltage surge between the contacts in the first electric contact SA1. As a result, occurrence of arc discharge is reduced at the moment when the first electrical contacts SA1 opens. During a momentary period in which the electrical contact device X2 is in the transition state, all the second electrical contacts SBi provide paths for the current, whereby a small amount of current flows through the entire electrical contact device X2.

After the transition state as described in the above, as the opening operation is continued so that the first contactor 40 and the second contactor 50 continue to move away from each other, all the contact faces 43*a* of the spring electrodes 43 come off the second contactor 50, and the electrical contact device X2 comes back to the open state (FIG. 4A). During this, occurrence of arc discharge at the moment when the contact faces 43*a* come off the second contactor 50 is appropriately reduced for the same reason why occurrence of arc discharge is reduced at the moment when each of the second electrical contacts SBi closes.

The electrical contact devices X1, X2 according to the present invention enable to appropriately reduce occurrence of arc discharge between electrical contacts, and to extend service life of the devices. Further, the electrical contact devices X1, X2 according to the present invention also reduce induced voltage which associates with the ON/OFF operations of the electrical contacts, and therefore, it is possible to sufficiently reduce electromagnetic noise which can be generated in the ON/OFF operations of the electrical contacts. Therefore, the electrical contact devices X1, X2 according to the present invention is also applicable, suitably to high-current relays for example.

The invention claimed is:

1. An electrical contact device comprising:

a first contactor including a first contact portion and a second contact portion;

a second contactor including a third contact portion facing the first contact portion and a fourth contact portion facing the second contact portion; and an electrical circuit including a first branch path and a second branch path disposed in parallel to each other, the first branch path having a first electrical contact provided by the first contact portion and the third contact portion, the second branch path having a second electrical contact provided by the second contact portion and the fourth contact portion, the first branch path having a smaller resistance in a closed state of the first electrical contact, the second branch path having a greater resistance in a closed state of the second electrical contact, wherein the first contact portion and the third contact portion make contact with each other after the second contact portion and the fourth contact portion make contact with each other in a closing operation in which the first contactor and the second contactor come closer to each other, and the second contact portion and the fourth contact portion come apart from each other after the first contact portion and the third contact portion come apart from each other in an opening operation in which the first contactor and the second contactor move away from each other.

2. The electrical contact device according to claim 1, wherein the first contact portion is spaced from the third contact portion by a distance greater than a distance between the second contact portion and the fourth contact portion, in an open state where the first electrical contact is in an open state and the second electrical contact is in an open state.

3. The electrical contact device according to claim 1, wherein the second branch path includes a resistor with a greater resistance than a contact resistance of the second electrical contact, the resistor being placed in series with the second electrical contact.

4. The electrical contact device according to claim 1, wherein the second electrical contact has a contact resistance which is greater than a contact resistance of the first electrical contact.

5. The electrical contact device according to claim 1, wherein the second contact portion or the fourth contact portion is made of a metal, an oxide or a nitride each including a metal element selected from a group consisting of Ta, W, C and Mo.

6. The electrical contact device according to claim 1, wherein the third contact portion and the fourth contact portion are included in one flat-surface electrode.

7. An electrical contact device comprising:

a first contactor including a plurality of first contact portions and a plurality of second contact portions;

a second contactor including a plurality of third contact portions each facing one of the first contact portions and a plurality of fourth contact portions each facing one of the second contact portions; and an electrical circuit including a plurality of first branch paths and a plurality of second branch paths disposed in parallel to each other, each of the first branch paths including a first electrical contact provided by the first contact portion and the third contact portion, each of the second branch paths including a second electrical contact provided by the second contact portion and the fourth contact portion, each of the first branch paths having a relatively small resistance in a closed state of the first electrical contact, each of the second branch paths having a relatively large resistance in a closed state of the second electrical contact, wherein the first contact portions and the third contact portions of all the first electrical contacts make contact with each other after the second contact portions and the fourth contact portions of all the second electrical contacts make contact with each other in a closing operation in which the first contactor and the second contactor come closer to each other, and the second contact portions and the fourth contact portions of all the second electrical contacts come apart from each other after the first contact portions and the third contact portions of all the first electrical contacts come apart from each other in an opening operation in which the first contactor and the second contactor move away from each other.

8. The electrical contact device according to claim 7, wherein each of the first contact portions is spaced from the respective one of the third contact portion by a distance greater than a distance between any one of the second contact portions and the respective one of the fourth contact portions, in an open state in which all of the first electrical contacts are in an open state and all of the second electrical contacts are in an open state.

9. The electrical contact device according to claim 7, wherein each of the second branch paths includes a resistor with a greater resistance than a contact resistance of the respective one of the second electrical contacts, the resistor being placed in series with the respective one of the second electrical contacts.

10. The electrical contact device according to claim 7, wherein each of the second electrical contacts has a contact resistance being greater than a contact resistance of any one of the first electrical contacts.

11. The electrical contact device according to claim 7, wherein at least either all of the second contact portions or all of the fourth contact portions are made of a metal, an oxide or a nitride each including a metal element selected from a group consisting of Ta, W, C and Mo.

12. The electrical contact device according to claim 7, wherein the first contactor includes: a base having a first surface and a second surface opposite to the first surface; a plurality of projections each provided on the first surface of the base and each having a tip provided by the first contact portion; and a first flat-surface electrode provided on the first surface and including a plurality of the second contact portions; the second contactor having a second flat-surface electrode including a plurality of the third contact portions and a plurality of the fourth electrode portions each being contactable respectively by the tips of the projections and the first flat-surface electrode.

13. The electrical contact device according to claim 12, wherein each of the second branch paths includes a resistor portion with a greater resistance than a contact resistance of the respective one of the second electrical contacts, the resistor portion being placed in series with the respective one of the second electrical contacts, the resistor portion being incorporated in the base and the projections.

14. The electrical contact device according to claim 13, wherein the base and the projections are made of silicon material, at least the resistor portion in the base and in the projections being doped with impurity.

15. The electrical contact device according to claim 12, wherein the second surface of the base is provided with a common electrode for electrical connection with a plurality of the resistor portions.

16. The electrical contact device according to claim 12, wherein the base has a flexible structure for each of the electrical contacts to absorb contacting pressure between the first contact portion and the third contact portion in a closed state of the electrical contact.

17. The electrical contact device according to claim 16, wherein the base includes cantilever beams each serving as the flexible structure, the projections being provided on the beams.

* * * * *